US005973303A

United States Patent [19]

Kuse

[11] Patent Number: 5,973,303

[45] Date of Patent: Oct. 26, 1999

[54] INDUCTION COOKING DEVICE WITH STONE SURFACE FOR USE AS A WORK SURFACE TOP

[76] Inventor: Kolja Kuse, Oberföhringerstrasse 175 RG, 81925, Munich, Germany

[21] Appl. No.: 09/125,417

[22] PCT Filed: Feb. 16, 1996

[86] PCT No.: PCT/EP96/00671

§ 371 Date: Aug. 17, 1998

§ 102(e) Date: Aug. 17, 1998

[87] PCT Pub. No.: WO97/30567

PCT Pub. Date: Aug. 21, 1997

[51] Int. Cl.[6] ..... H05B 6/12

[52] U.S. Cl. ..... 219/622; 219/624; 219/649; 219/464; 126/211; 126/390; 99/DIG. 14

[58] Field of Search ..... 219/622, 623, 219/624, 620, 647, 649, 464; 126/211, 39 H, 390; 99/DIG. 14, 454

[56] References Cited

U.S. PATENT DOCUMENTS 4,221,672 9/1980 McWilliams ..... 252/62
4,625,098 11/1986 Joe ..... 219/462
5,043,559 8/1991 Scott ..... 219/464
5,640,947 6/1997 Shute ..... 126/211

FOREIGN PATENT DOCUMENTS 0 637 898 2/1995 European Pat. Off. .

*Primary Examiner*—Philip H. Leung
*Attorney, Agent, or Firm*—Horst M. Kasper

[57] ABSTRACT

An induction cooktop is formed of a light construction of a stone surface. The surface of the induction cooktop can also be used as a robust work surface top. The cooktop includes a uniformly flat, sufficiently thin stone plate (1) being laid on an equally flat, reinforcement plate (2) for mechanical stability. Induction coils (3 or 3*a*) are positioned in or under the reinforcement plate for inductive heating of the cooking pots. This arrangement is additionally stabilized through a frame (4) and a substructure (7) and is closed off at the edge through a border or a trim (8) or embedded in a work surface top (6) surrounding the cooktop.

11 Claims, 4 Drawing Sheets

INDUCTION COOKING DEVICE WITH STONE SURFACE FOR USE AS A WORK SURFACE TOP

The present invention relates to the field of kitchen technology for induction stoves, in particular the field of stove top surfaces for induction cooking stoves and starts with the European printed patent document EP 0637898 A1. The present invention thus starts with the state of the art, where a stone plate is employed simultaneously as a work surface top and as a stove surface top for inductive cooking. The surface of stone is selected for the reason that the sturdiness, the ease of care, and in particular the insensitivity against burning food residues into the surface of the stove surface top make it advantageous for employment in the kitchen. For this purpose, the stone plate has to be mechanically stabilized in order to counter a possible crack formation based on the high heat development during cooking. For this purpose, the stone plate is reinforced mechanically by a reinforcement, for example by way of a carbon fiber lamination, which carbon fiber lamination is adhesively glued between two halves of the plate with a heat-resistant compound material in order to prevent crack formation based on tensile stress. The induction coils are then placed into countersunk recesses up to close under the surface of the stone, wherein the underside of the stone surface is again protected at this location with a carbon fiber laminate against crack formation (compare EP 0637898 A1). The expensive production of this arrangement caused by several expensive and time-consuming work steps, as well as caused by the high weight of this massive form of construction can however by now be avoided with the aid of modern stone processing methods based on large-surface cutting of thin stone plates with a water jet.

On the one hand, it is an object of the present invention to introduce this new technology for the arrangement of a light-weight construction of induction stove surfaces made of stone in the kitchen technology, which serves also for the production of conventional kitchen work plates made of stone and which makes possible the production of stone stove surface tops with simultaneous suitability as a kitchen work surface plate in a continuous fashion. On the other hand, the invention assures a clearly improved protection against the cracking of the stone surface upon heat interaction.

This object is accomplished by the features of claim 1. In particular, a uniformly thin-cut stone surface plate is in this case connected over the full face in a planar and continuous way with a reinforcement plate. The large-face alignment in a purely horizontal direction at each location of the reinforcement, solidly adhesively attached to the stone, serves for the optimum tensile stabilization of the stone in order to prevent the crack formation in the stone by heat. The induction coils are applied below, or are integrated into the continuous reinforcement plate.

In addition, an additional torsion stabilization for receiving the pressure on the surface and for the connection to the subconstruction or kitchen cabinet supporting the stove surface top can be produced by a subconstruction in the form of a frame in light-weight construction, for example of wood or of aluminum. The front edge of the surface plate can be reinforced by a trim made of the same or of a different stone material in the thickness, which gives the surface plate the appearance of a massive stone surface plate or granite surface plate. Other materials, for example wood or metal, can also be employed as a trim or border.

The high tensile stability based on the throughout horizontal alignment of the reinforcement is an essential advantage achieved with the present invention, wherein anyway substantially lesser tensile forces occur based on the low thickness of the stone surface plate than is the case in a massive construction form, and this occurs with less weight. This construction form of stove surface tops made of stone assures in addition the flexible movable application of the induction coils below the stone surface, since the surface top exhibits essentially the same thickness at all positions. This allows now at any time after the installation to move the position of the cooking field and to move it arbitrarily, if this should for example become necessary based on a change of residence, even if a kitchen installation has already occurred with the induction coils placed below a continuous kitchen work surface plate or stove surface plate made of stone. This advantage can increase in a decisive fashion the acceptance of kitchen installations with kitchen work surface plates made of stone, which kitchen installations had to be left behind under conventional circumstances in case of a change of residence, first because they could only be transported with difficulty and under risk of breakage, and second for the reason that, once the stove placement was firmly installed in the work surface plate, the local placing of the stove arrangement could no longer be changed.

The stove surface top can still be inserted easily and without problems as heretofore into a desired kitchen work surface plate of stone, granite or wood with the described technology in an embodiment limited to the cooking field proper, even only for one cooking pot, and thus the cooking field of stone can be advantageously combined with different kinds of stones or materials such as wood. A further advantage is thus the low cost integration of a stove surface top made of stone into any other desired kitchen work surface plates, their combination with other materials, as well as the problem-free exchangeability.

Initially, a thin stone surface plate (1) is cut to conform to the size of the future cooking field or, respectively, of the working field to be combined, for a possible embodiment of the invention, wherein the stone surface plate (1) has a planar underside which is as rough as possible, possibly grooved, but essentially continuous. The surface is planar and should be polished as smooth as possible for simple maintenance. A carbon-fiber laminate of constant thickness (2) is applied to the underside of this stone surface plate, wherein the carbon-fiber laminate enters into a planar solid connection with the surface plate, and wherein the carbon-fiber laminate is adhesively attached over the full expanse to the stone surface plate after the hardening of the, if at all possible, heat-resistant laminar material in case of a plane with purely horizontal fiber direction.

The induction coils **(3*a*) can either be cast directly into the laminate or they are applied afterwards mechanically changeable in position below the carbon fiber surface (3)**.

Figure 1:
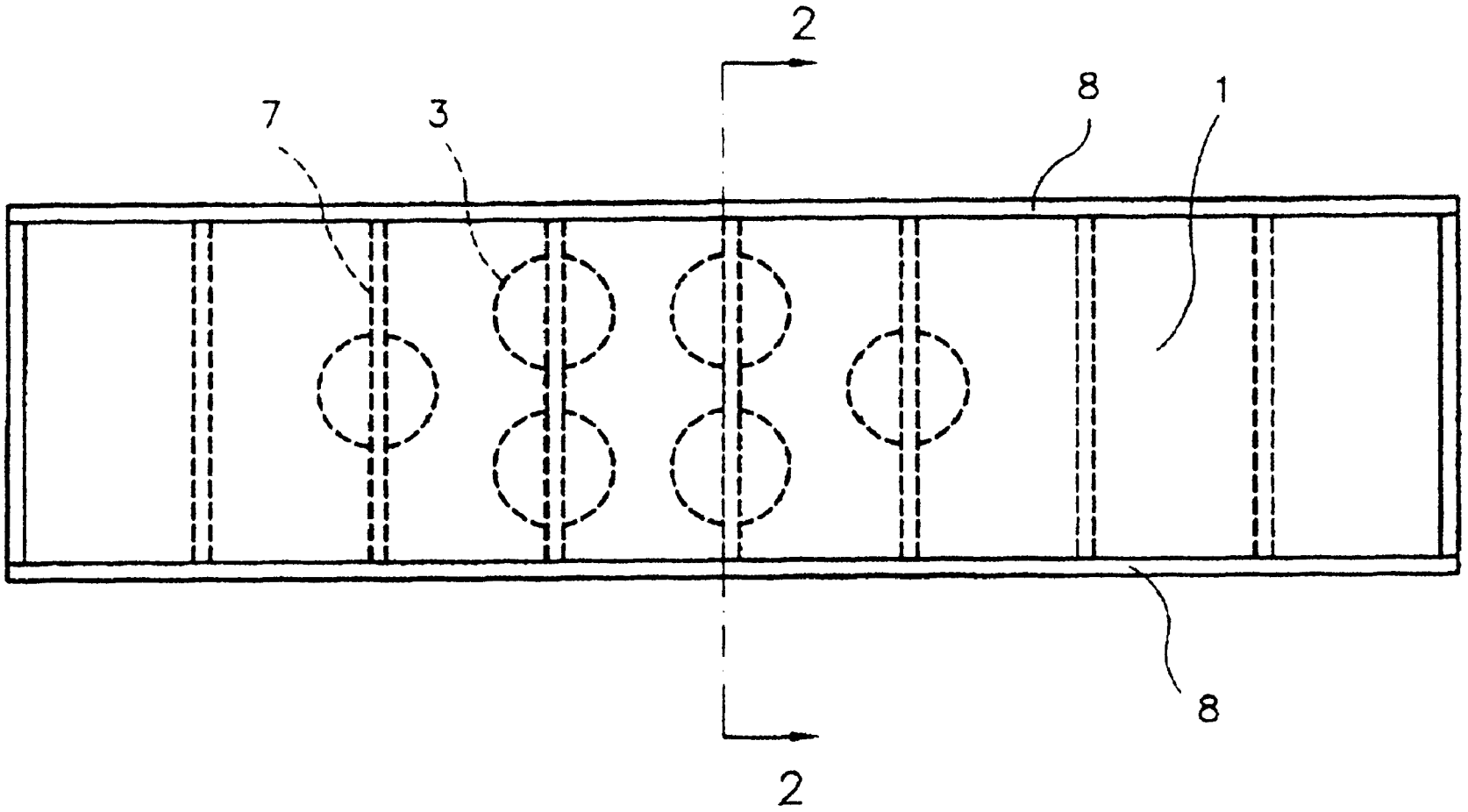
FIG. 1 shows an embodiment according to the invention of a stove surface top made of stone, which forms simultaneously a continuous kitchen work surface plate.
Figure 2:
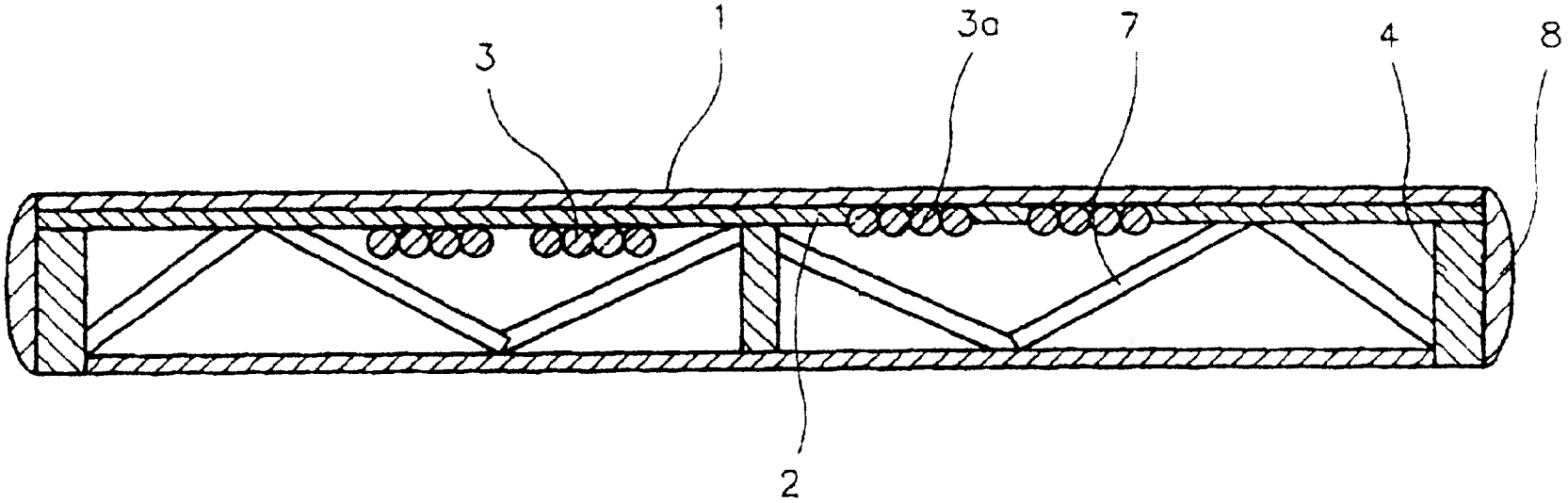
FIG. 2 shows a cross-section A—A through the stove surface top of FIG. 1, wherein the left half and the right half show two alternative placements of the induction coils.

If the thus resulting and as thin as possible stove surface top, made of stone, is to be at the same time a continuous kitchen work surface plate (6) (FIGS. 1 and 2), then a part or better the complete surface top (6) is reinforced in the way described above and is additionally stabilized by a subconstruction formed by a light metal frame (7). The front and possibly side and rear borders (8) of the surface plate (6) are furnished with the same stone material as the stove surface top (6), however, they are correspondingly thicker, or made of a different material, for example metal or wood (compare FIGS. 1 and 2).

If the stove surface top comprised of (1) and (2) is to be embedded into a kitchen work surface plate (6), for example made of wood (FIGS. 3/4), then the stove surface top is stabilized by an outer frame (4), for example of aluminum, relative to the torsion stiffness or is simply inserted into a groove (5) of the material surrounding the stove surface top of the kitchen work surface plate.

Figure 3:
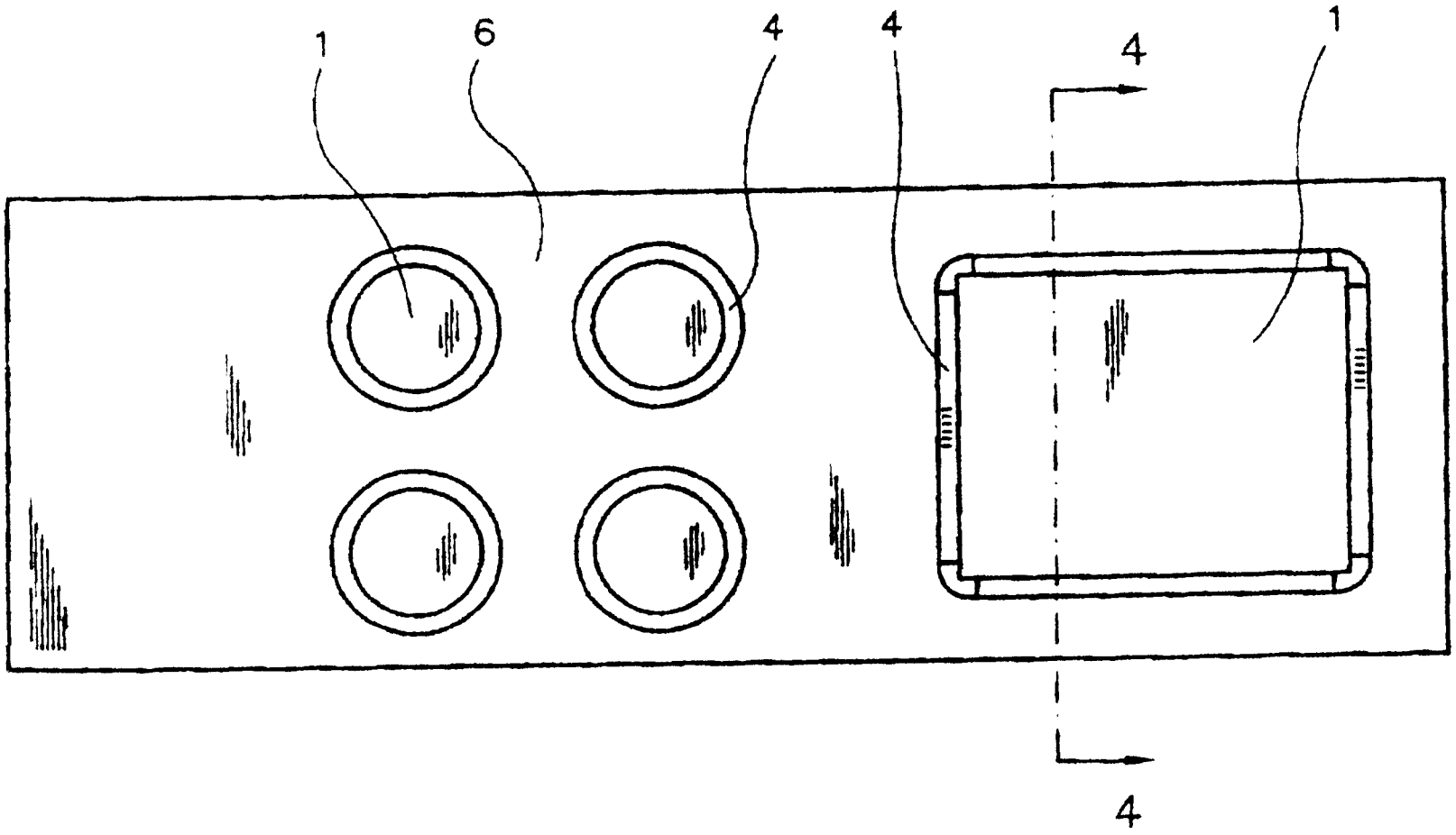
FIG. 3 shows a conventional continuous kitchen work surface plate, wherein two different embodiments of a stove surface top made of stone are embedded into the kitchen work surface plate.
Figure 4:
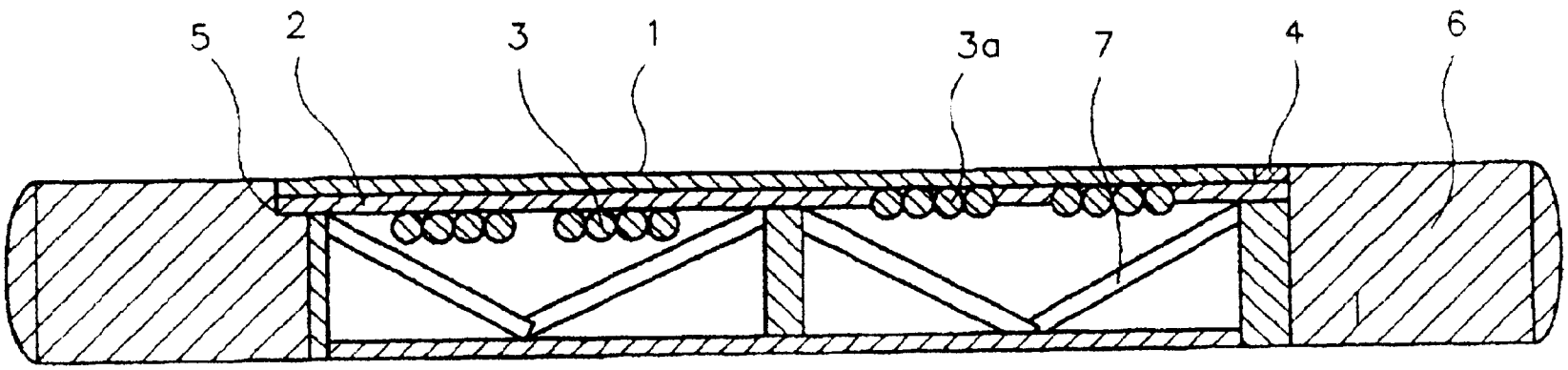
FIG. 4 shows a cross-section B—B through a stove surface top made of stone according to FIG. 3, wherein the left half and the right half show two alternative placements of the induction coils.

It can be advantageous also in this case to support the stove surface top by a stabilizing subconstruction (7) (compare FIGS. 3 and 4).

In addition to carbon fiber laminate, other compositions, stable against tension under interaction with heat, such as glass ceramics, other synthetically generated ceramics, as well as natural materials, such as for example coral construction material and mother of pearl, which are produced by gene technology and also new gene-technologically produced fibers, such as the fibers of the silk moth, which have an enormous tensile strength and are therefore in a position to oppose the cracking of the stone upon heat interaction.

In connection with the construction of stove surface plates made of stone the recognition is important that, as basis of the present invention, the fiber course at each location in the region of heat interaction, i.e. in the entire region of the cooking field, has to be throughout horizontal without interruption in order to exclude the formation of cracks at each location on the cooking field.

I claim:

1. Arrangement with an induction stove surface top made of stone and mechanically stabilized by means of a fiber-containing reinforcement, being simultaneously suitable as kitchen work surface plate, wherein the fiber-containing reinforcement is disposed below a continuous, uniformly thin stone surface plate having a planar upper side and underside, wherein the fiber-containing reinforcement is also connected over the full face continuously to an underside of the stone surface plate, wherein the fiber-containing reinforcement is uniformly thin and extremely heat-resistant, whereby there is assured upon heat interaction a tensile-resistant reinforcement with a continuous horizontal alignment of a thus optimized tensile stress take-up, and wherein induction spools are placed below or in the continuous fiber-containing reinforcement, wherein it is assured that the induction coil practically exhibits at a respective attachment location a constant distance to an upper surface of the stone surface plate.

2. Arrangement according to claim 1, further comprising an additional stabilization in light-weight construction disposed below the fiber-containing reinforcement for a total stabilization of the arrangement.

3. Arrangement according to claim 2, wherein the induction stove surface top made of stone projects on one or both sides over the cooking field proper and is thus also a continuous kitchen work surface plate.

4. Arrangement according to claim 2, wherein the induction stove surface top is embedded into another kitchen work surface plate made of a member selected from the group consisting of stone, wood, glass, metal, ceramics, and plastics.

5. Arrangement according to claim 1, wherein the fiber-containing reinforcement is constituted of a composite material or a laminate.

6. Arrangement according to claim 1, wherein the fiber-containing reinforcement is constituted of a glass-containing material.

7. Arrangement according to claim 1, wherein the fiber-containing reinforcement is constituted of artificial stone or ceramic material.

8. Arrangement according to claim 1, wherein the fiber-containing reinforcement is constituted of a synthetically produced mother-of-pearl or coral material.

9. Arrangement according to claim 1, wherein the fibers are carbon fibers.

10. Arrangement according to claim 1, wherein the fibers of the fiber-containing reinforcement are silk-spun threads.

11. Arrangement according to claim 1, further comprising shielding grates of a metallic material disposed, with reference to surface, around the induction coils below the stone surface plate, which effect a shielding of an electromagnetic radiation at edges of the cooking sites.

* * * * *